US009972947B2

(12) United States Patent
Sekino et al.

(10) Patent No.: US 9,972,947 B2
(45) Date of Patent: May 15, 2018

(54) CONNECTOR

(71) Applicant: Yazaki Corporation, Minato-ku, Tokyo (JP)

(72) Inventors: Tetsuya Sekino, Shizuoka (JP); Nobuyuki Sakamoto, Shizuoka (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days. days.

(21) Appl. No.: 15/661,076

(22) Filed: Jul. 27, 2017

(65) Prior Publication Data

US 2018/0034217 A1 Feb. 1, 2018

(30) Foreign Application Priority Data

Jul. 29, 2016 (JP) ..... 2016-149200

(51) Int. Cl.
*H01R 13/70* (2006.01)
*H01R 13/703* (2006.01)

(52) U.S. Cl.
CPC ..... *H01R 13/7031* (2013.01)

(58) Field of Classification Search
CPC ..... H01R 13/7031; H01R 13/7032; H01R 13/7033; H01R 13/7034
See application file for complete search history.

(56) References Cited

U.S. PATENT DOCUMENTS 5,391,087 A 2/1995 Fukuda
6,942,510 B2 * 9/2005 Nakamura ..... H01R 13/7032 439/188
7,275,946 B2 * 10/2007 Ohtaka ..... H01R 13/7032 200/51.1
7,287,993 B2 * 10/2007 Fujii ..... H01R 13/62938 439/157
7,402,057 B1 * 7/2008 Strang ..... H01R 13/7032 439/188
7,458,835 B2 * 12/2008 Kobayashi ..... H01R 13/641 439/188
7,488,197 B2 * 2/2009 Shinozaki ..... H01R 13/7031 439/489

(Continued)

FOREIGN PATENT DOCUMENTS

JP 06-181083 A 6/1994

*Primary Examiner* — Ross Gushi
(74) *Attorney, Agent, or Firm* — Sughrue Mion, PLLC

(57) ABSTRACT

A connector includes a first housing, a second housing, a short-circuiting terminal, and a release portion configured to release contact between the first terminals and the contact pieces. The contact piece includes a contact portion provided to be in contact with the first terminal, and a sliding protrusion protruding from the contact portion in a direction intersecting a fitting direction of the housings. The release portion includes a sliding slope sliding on the sliding protrusion to displace the contact piece, a support portion continuously provided with the sliding slope, the support portion coming into contact with the sliding protrusion and holding the contact piece is displaced in a state, and a contact housing portion arranged from the sliding slope and the support portion in a direction crossing a fitting direction of the first housing and the second housing, the contact housing portion housing the contact portion the fitted state.

3 Claims, 10 Drawing Sheets

(56) References Cited

U.S. PATENT DOCUMENTS

| | | | | |
|---|---|---|---|---|
| 7,530,838 | B2 * | 5/2009 | Ohara | H01R 13/641 439/489 |
| 7,955,104 | B1 * | 6/2011 | Wicks | H01R 13/7032 439/188 |
| 8,851,921 | B2 * | 10/2014 | Segawa | H01R 13/6271 439/489 |
| 9,379,472 | B2 * | 6/2016 | Hara | H01R 13/05 |
| 9,413,108 | B2 * | 8/2016 | Iwatani | H01R 13/62933 |
| 9,425,554 | B2 * | 8/2016 | Iwatani | H01R 13/6275 |
| 9,640,922 | B2 * | 5/2017 | Kanemura | H01R 13/7032 |
| 9,660,393 | B2 * | 5/2017 | Shinmi | H01R 13/7032 |
| 9,837,771 | B2 * | 12/2017 | Tedeschi | H01R 13/7032 |
| 2004/0229487 | A1 * | 11/2004 | Lutsch | H01R 13/7032 439/188 |

* cited by examiner

CONNECTOR

CROSS REFERENCE TO RELATED APPLICATIONS

This application claims the priority of Japanese Patent Application No. 2016-149200, filed on Jul. 29, 2016, the entire content of which are incorporated herein by reference.

BACKGROUND

Technical Field

The present invention relates to a connector. More specifically, the present invention relates to a connector having a short-circuiting terminal for connecting a plurality of terminals housed in a housing.

Related Art

Conventional connectors include a first housing housing female terminals as a plurality of first terminals, a second housing housing male terminals as a plurality of second terminals connectable to the respective female terminals, wherein the second housing is fittable to the first housing, a short-circuiting terminal housed in the first housing, wherein the short-circuiting terminal has contact pieces contacting the respective female terminals which are adjacent to each other, and an insulating member as a release portion provided on the second housing, wherein the release portion displaces the contact pieces to release contact between the male terminals and the contact pieces (See, for example, JP 06-181083 A).

In this connector, for example, two adjacent female terminals among the plurality of female terminals housed in the first housing are connected to an airbag circuit that controls the operation of the airbag.

The two adjacent female terminals are connected with each other through the short-circuiting terminal by contacting the contact pieces of the short-circuiting terminal housed in the first housing in a state where the first housing and the second housing are not fit with each other.

In this manner, since the two female terminals are connected with each other via the short-circuiting terminal in a state where the first housing and the second housing are not fit with each other, no potential difference is generated between the two female terminals, thereby preventing malfunction of the airbag.

In the connection between the two female terminals and the short-circuiting terminal, when the first housing and the second housing are fit, the insulating member of the second housing is inserted between the female terminals and the contact piece of the short-circuiting terminal. The contact piece is displaced and the contact between the female terminal and the contact piece is released. The connection between the two female terminals and the short-circuiting terminal is released.

SUMMARY

In the connector as disclosed in JP 06-181083 A, the contact piece of the short-circuiting terminal is provided with the contact portion which comes into contact with the first terminal. When the contact portion slides on the release portion, the contact piece is displaced, and the connection between the first terminal and the short-circuiting terminal is released.

However, when the contact portion of the contact piece slides on the release portion as in the connector of JP 06-181083 A, damage or deformation may occur on the contact portion. Thus, the connection reliability between the first terminal and the short-circuiting terminal may deteriorate.

It is, therefore, an object of the present invention to provide a connector capable of ensuring connection reliability between a first terminal and a short-circuiting terminal.

A connector according to an aspect of the present invention includes a first housing housing a plurality of first terminals, a second housing housing a plurality of second terminals connectable to the respective first terminals, the second housing being fittable to the first housing, a short-circuiting terminal housed in the first housing, the short-circuiting terminal having a contact piece contacting the respective first terminals which are adjacent to each other, and a release portion provided on the second housing, the release portion displacing the contact piece to release contact between the first terminals and the contact pieces. The contact piece includes a contact portion provided so as to be in contact with the first terminal, and a sliding protrusion protruding from the contact portion in a direction intersecting a direction in which the first housing and the second housing are fit together. The release portion includes a sliding slope sliding on the sliding protrusion to displace the contact piece when the first housing and the second housing are fit together, a support portion provided to be continuous with the sliding slope, the support portion coming into contact with the sliding protrusion and holding a state in which the contact piece is displaced in a state where the first housing and the second housing are fit together, and a contact housing portion arranged from the sliding slope and the support portion in a direction crossing a direction in which the first housing and the second housing are fit together, the contact housing portion housing the contact portion from when fitting of the first housing and the second housing is started until when the fitting is completed.

In this connector, when the first housing and the second housing are fit together, the release portion has a sliding slope which slides on the sliding protrusion to displace the contact piece. Thus, it is possible to displace the contact piece without sliding the contact portion on the sliding slope.

In addition, the release portion includes the support portion which is provided continuously with the sliding slope, and which in a state where the first housing and the second housing are fit with each other, comes into contact with the sliding protrusion and holds a state in which and the contact piece is displaced. Thus, it is possible to hold the state in which the contact piece is displaced without bringing the contact portion and the support portion into contact with each other.

Further, the release portion includes a contact housing portion which is arranged in a direction crossing the direction in which the first housing and the second housing are fit together from the sliding slope and the support portion, and which houses the contact portion from when fitting of the first housing and the second housing is started until when the fitting is completed. Thus, the contact portion does not interfere with the sliding slope and the support portion of the release portion when the contact piece is displaced. Consequently, the contact portion can be protected.

Since with this connector, the contact portion can be protected while the contact piece is displaced, no damage or deformation occurs at the contact portion. Thus, the connection reliability between the first terminal and the short-circuiting terminal can be secured.

The contact housing portion may be provided with an insulating portion arranged between the contact portion and the first terminal in a state where the first housing and the second housing are fit together.

Since in a state where the first housing and the second housing are fit together, the contact housing portion is provided with an insulating portion arranged between the contact portion and the first terminal, insulation between the contact portion and the first terminal can be maintained in a state in which the first housing and the second housing are fit together. Thus, conduction between the short-circuiting terminal and the first terminal can be prevented.

The release portion may include a displacement portion arranged on the protruding direction side of the sliding protrusion with respect to the sliding slope, the displacement portion sliding on the sliding protrusion to displace the contact piece in a direction away from the sliding slope when the first housing and the second housing are fit together.

Since when the first housing and the second housing are fit together, the release portion has a displacement portion that slides on the sliding protrusion to displace the contact piece in a direction away from the sliding slope, the sliding movement between the sliding protrusion and the sliding slope can be maintained by the restoring force of the contact piece. Thus, the release portion can stabilize the displacement of the contact piece.

A connector according to the aspect of the present invention provides a connector capable of ensuring connection reliability between a first terminal and a short-circuiting terminal.

DETAILED DESCRIPTION

Figure 1:
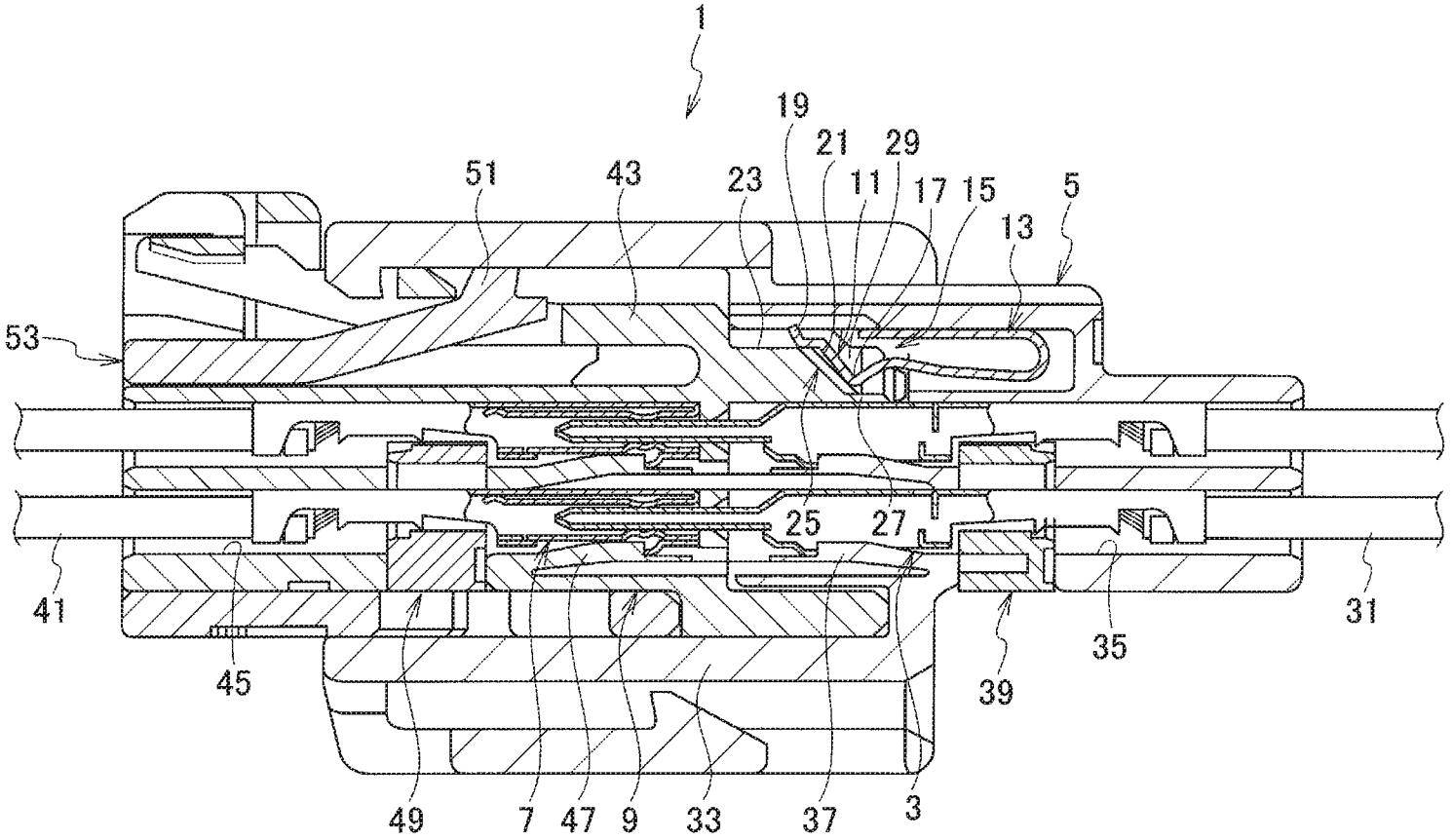
FIG. 1 is a cross-sectional view of a connector according to an embodiment of the present invention.
Figure 2:
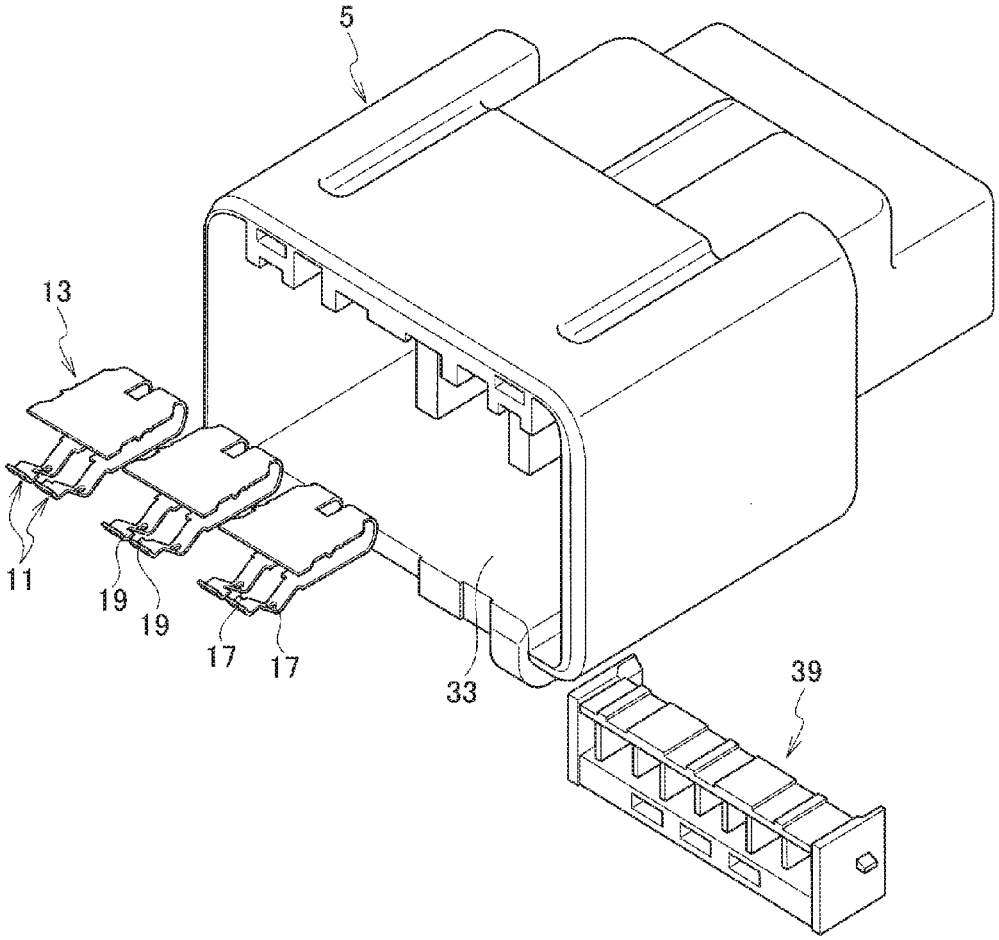
FIG. 2 is an exploded perspective view of a first housing of a connector according to the embodiment of the present invention.
Figure 3:
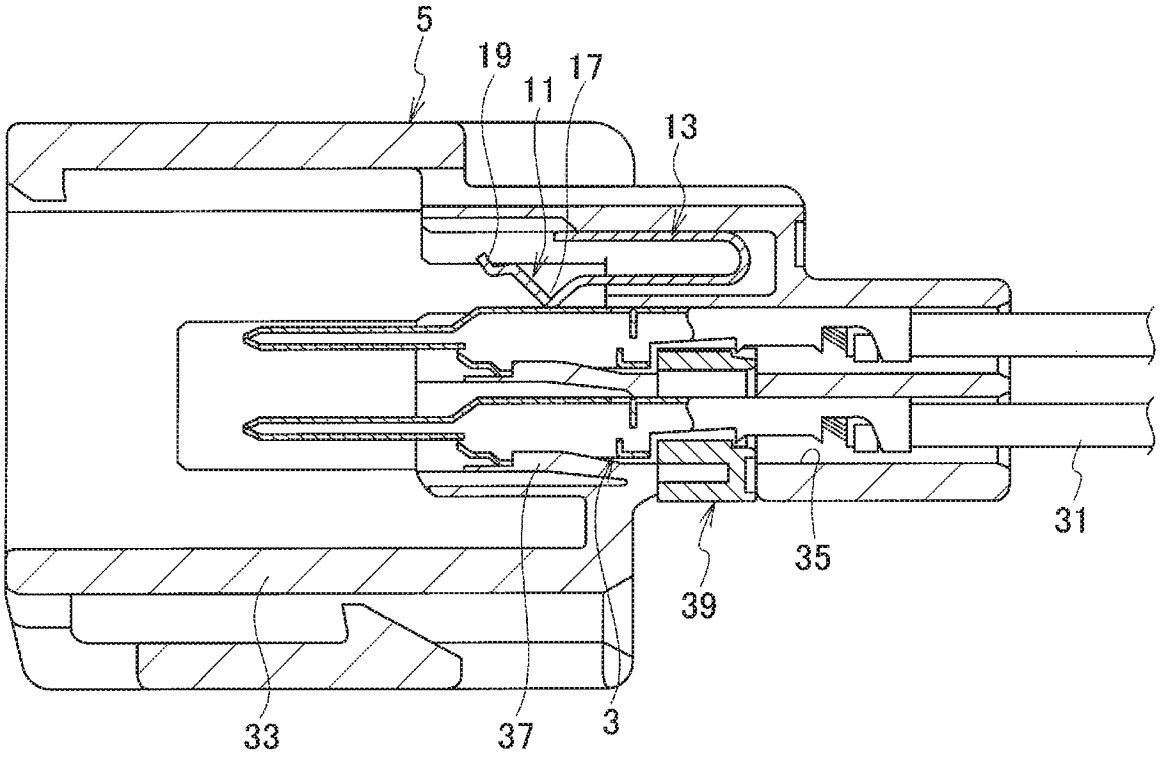
FIG. 3 is a cross-sectional view of a first housing of a connector according to the embodiment of the present invention.
Figure 4:
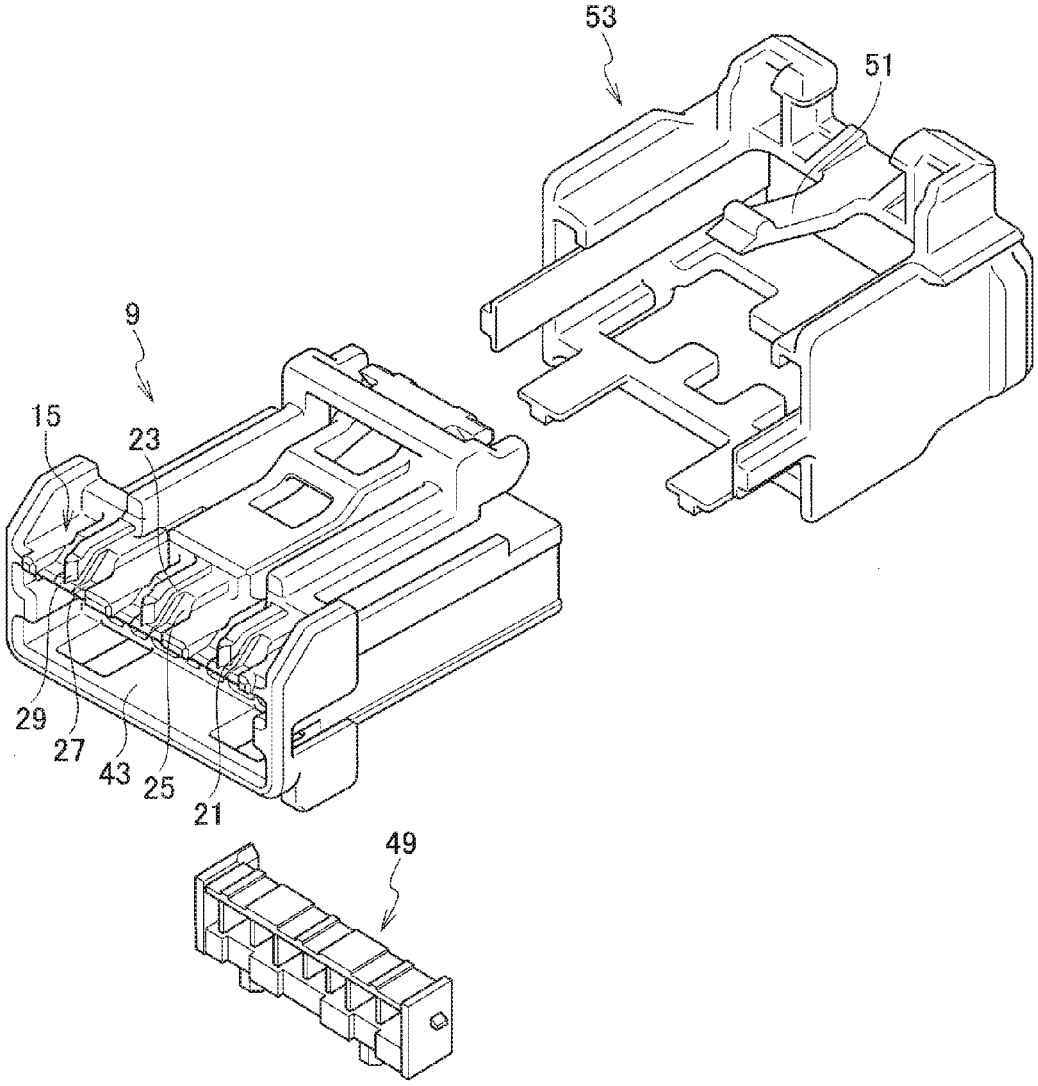
FIG. 4 is an exploded perspective view of a second housing of a connector according to the embodiment of the present invention.
Figure 5:
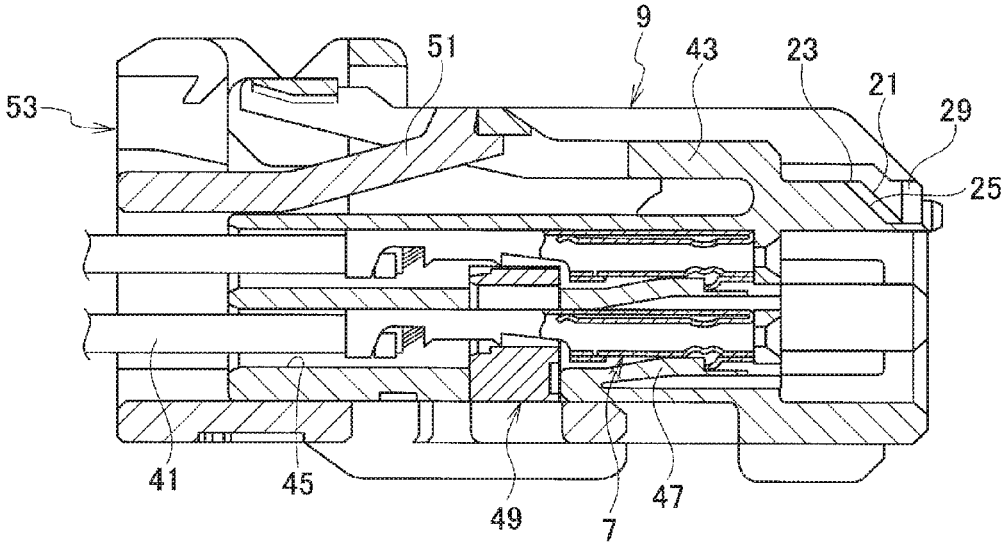
FIG. 5 is a cross-sectional view of a second housing of a connector according to the embodiment of the present invention.
Figure 6:
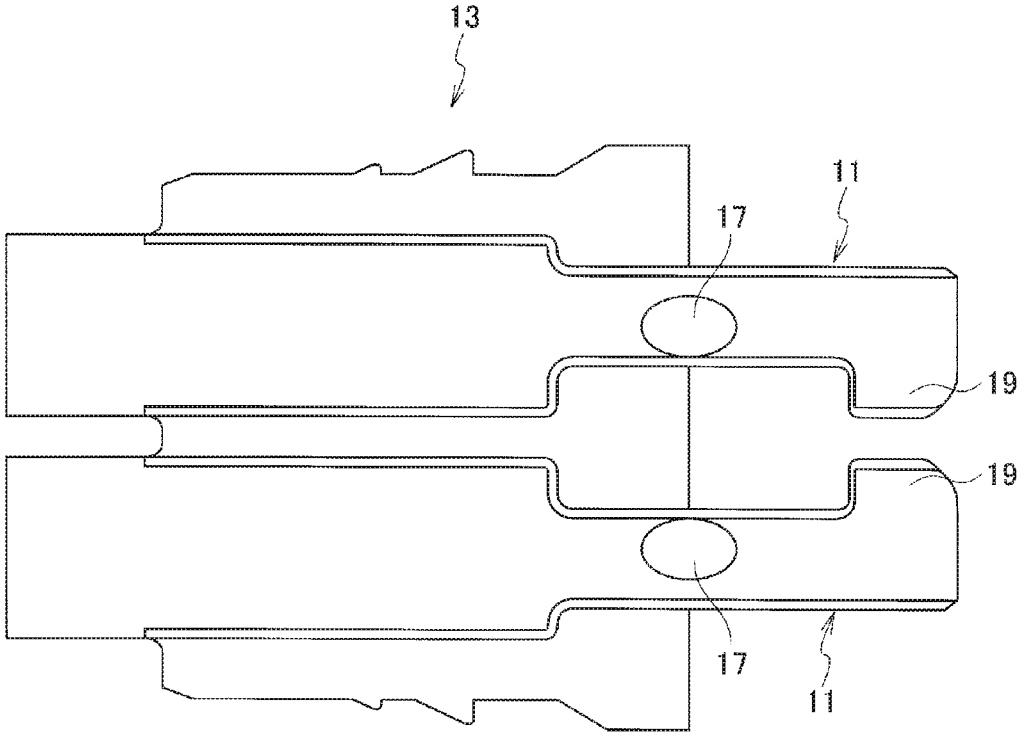
FIG. 6 is a plan view of a short-circuiting terminal of a connector according to the embodiment of the present invention.
Figure 7:
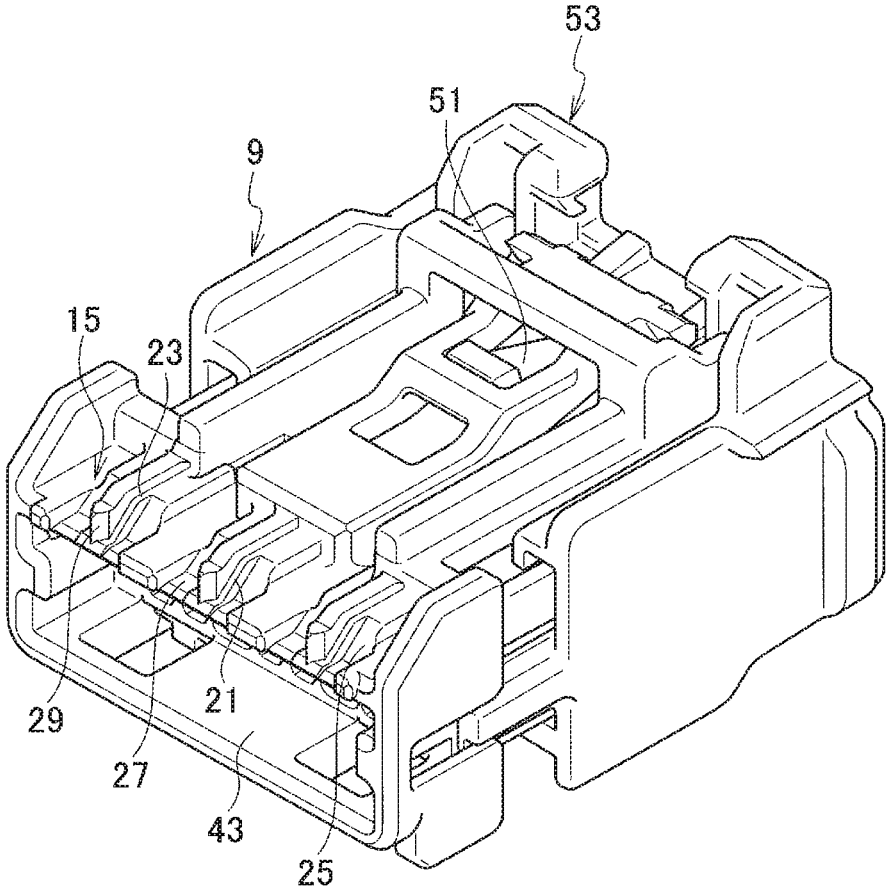
FIG. 7 is a perspective view of the second housing of the connector according to the embodiment of the present invention.
Figure 8:
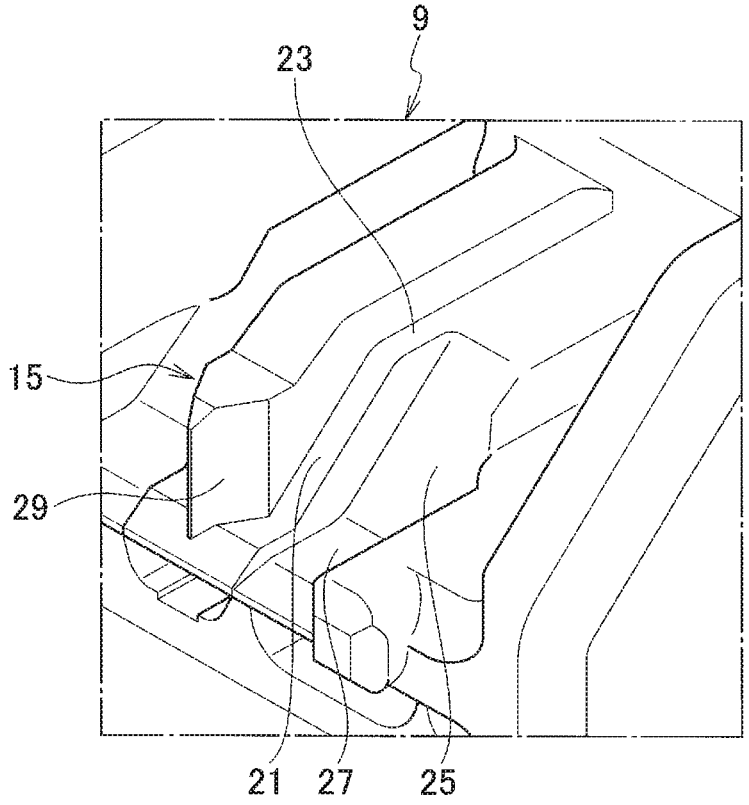
FIG. 8 is an enlarged view of a main part of FIG. 7.
Figure 9:
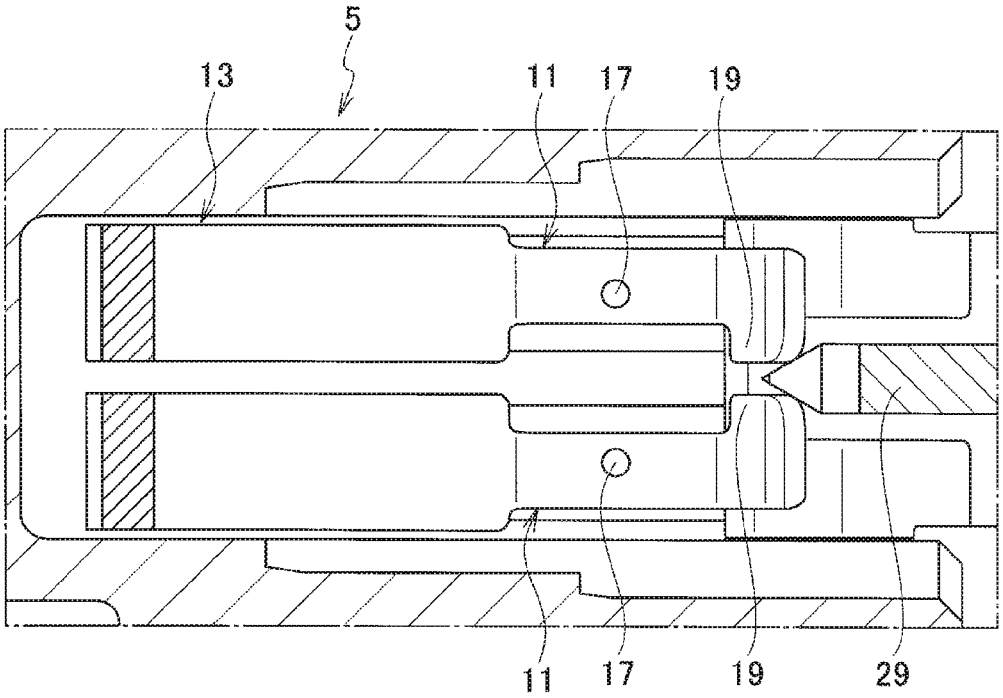
FIG. 9 is an enlarged cross-sectional view of the essential part when fitting the first housing and the second housing of the connector according to the embodiment of the present invention.
Figure 10:
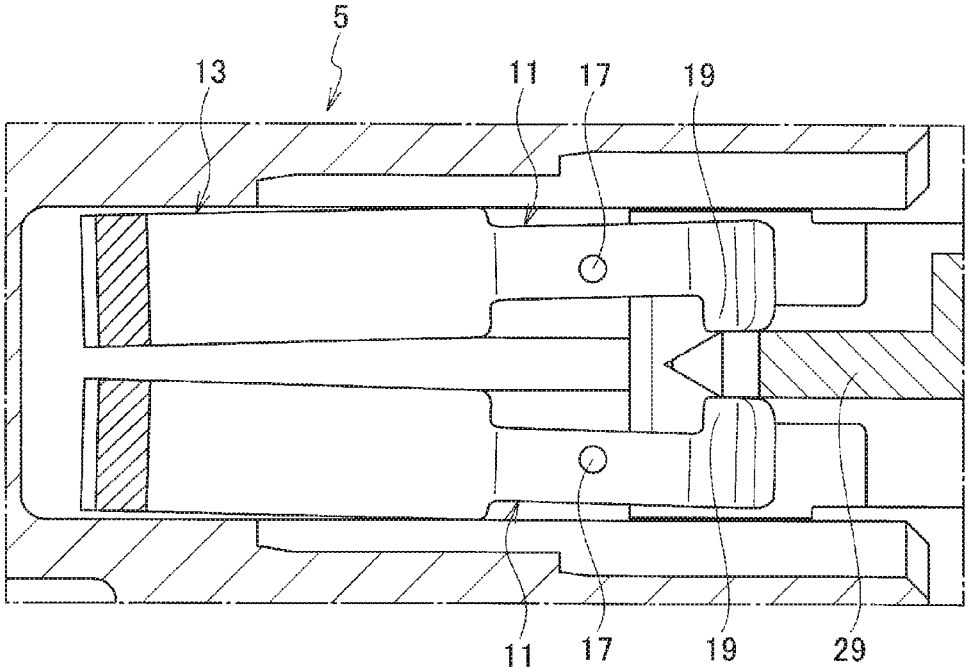
FIG. 10 is an enlarged cross-sectional view of an essential part when the first housing and the second housing of the connector according to the embodiment of the present invention are fit together.

A connector according to an embodiment of the present invention will be described with reference to FIGS. 1 to 10.

The connector 1 according to the present embodiment includes a first housing 5 housing a plurality of first terminals 3, a second housing 9 housing a plurality of second terminals 7 connectable to the respective first terminals 3, the second housing 9 being fittable to the first housing 5, a short-circuiting terminal 13 housed in the first housing 5, the short-circuiting terminal 13 having contact pieces 11, 11 contacting the respective first terminals 3, 3 which are adjacent to each other, and a release portion 15 provided on the second housing 9, the release portion 15 displacing the contact pieces 11 to release contact between the first terminals 3 and the contact pieces 11.

The contact piece includes a contact portion provided so as to be in contact with the first terminal, and a sliding protrusion protruding from the contact portion in a direction intersecting a direction in which the first housing and the second housing are fit together.

The release portion includes a sliding slope sliding on the sliding protrusion to displace the contact piece when the first housing and the second housing are fit together, a support portion provided to be continuous with the sliding slope, the support portion coming into contact with the sliding protrusion and holding a state in which the contact piece is displaced in a state where the first housing and the second housing are fit together, and a contact housing portion arranged from the sliding slope and the support portion in a direction crossing a direction in which the first housing and the second housing are fit together, the contact housing portion housing the contact portion from when fitting of the first housing and the second housing is started until when the fitting is completed.

The contact housing portion is provided with an insulating portion arranged between the contact portion and the first terminal in a state where the first housing and the second housing are fit together.

The release portion includes a displacement portion arranged on the protruding direction side of the sliding protrusion with respect to the sliding slope, the displacement portion sliding on the sliding protrusion to displace the contact piece in a direction away from the sliding slope when the first housing and the second housing are fit together.

As shown in FIGS. 1 to 10, each of a plurality of first terminals 3 is composed of a male terminal having a tab-shaped connecting portion. The plurality of first terminals 3 are electrically connected to respective terminal portions of a plurality of electric wires 21 connected to an airbag circuit for controlling the operation of the airbag.

The plurality of first terminals 3 are inserted into the first housing 5 through an opening formed in the first housing 5 and housed in the first housing 5.

The first housing 5 is made of an insulating material such as synthetic resin. The first housing 5 is provided with a first fitting portion 33 into which the second housing 9 can be fit on the opposite side of the opening into which the first terminal 3 is inserted. A plurality of first terminal housing chambers 35 for housing the first terminals 3 are provided on the bottom of the first fitting portion 33.

A first locking lance 37 for locking the first terminal 3 is deflectably provided in each of the plurality of first terminal housing chambers 35 of the first housing 5. Furthermore, the first housing 5 is provided with a hole portion communicating with the plurality of first terminal housing chambers 35. By inserting the first spacer 39 into the hole portion, the plurality of first terminals 3 inserted into the first housing 5 are double-locked in the first housing 5 by the first locking lances 37 and the first spacer 39.

The plurality of first terminals 3 housed in the first housing 5 as described above are connected to the plurality of second terminals 7 housed in the second housing 9 by fitting the second housing 9 into the first fitting portion 33 of the first housing 5.

Each of the plurality of second terminals 7 is constituted by a female terminal having a box-like connecting portion into which the tab-like connecting portion of the first terminal 3 can be inserted. The plurality of second terminals 7 are electrically connected to respective terminal portions of a plurality of electric wires 41 connected to a power source, a device, or the like.

The plurality of second terminals 7 are inserted into the second housing 9 through openings formed in the second housing 9 and housed in the second housing 9.

The second housing 9 is made of an insulating material such as a synthetic resin. The second housing 9 is provided with the second fitting portion 43 that can be inserted into the first fitting portion 33 of the first housing 5 on the opposite side of the opening into which the second terminal 7 is inserted. A plurality of second terminal housing chambers 45 for housing the second terminals 7 are provided inside the second fitting portion 43.

Second locking lances 47 for locking the respective second terminals 7 are deflectably provided in a plurality of second terminal housing chambers 45 of the second housing 9. Further, the second housing 9 has a hole portion communicating with the plurality of second terminal housing chambers 45. Since the second spacer 49 is inserted into the hole portion, the plurality of second terminals 7 inserted into the second housing 9 are double-locked into the second housing 9 by the second locking lance 47 and the second spacer 49.

Here, a cap housing 53 is assembled to the second housing 9 on the outer periphery of the second housing 9 on the drawer side of the electric wire 41 at the temporary locking position (see FIG. 5) via a deflectable locking portion 51.

When the first housing 5 and the second housing 9 are half-fit together, the cap housing 53 is temporarily locked at a temporary locking position which is not located at the full locking position. When the first housing 5 and the second housing 9 are fit together, the locking position of the locking portion 51 of the cap housing 53 shifts to the full locking position (see FIG. 1).

In this manner, the state in which the first housing 5 and the second housing 9 are fit together can be detected by the transition between the temporary locking position and the full locking position of the cap housing 53.

By the fitting of the second fitting portion 43 of the second housing 9 and the first fitting portion 33 of the first housing 5, the first terminal 3 housed in the first housing 5 and the second terminal 7 housed in the second housing 9 are electrically connected.

In a state where the fitting between the first housing 5 and the second housing 9 is released for maintenance or the like, a potential difference occurs due to static electricity or the like between the plurality of first terminals 3 which are housed in the first housing 5 and which are connected to the airbag circuit. Thus, the airbag may malfunction.

Therefore, in order to prevent a potential difference from occurring between the plurality of the first terminals 3, a plurality of short-circuiting terminal 13 for electrically connecting two adjacent first terminals 3, 3 among the plurality of the first terminals 3 are housed in the first housing 5.

The plurality of short-circuiting terminal 13 are each made of a single conductive material subjected to press working or bending, and have two contact pieces 11, 11, each elastically deformable at one end.

The two contact pieces 11, 11 are provided so as to be elastically deformable in either the up-down direction or the left-right direction. Each contact piece 11 has a contact portion 17 protruding toward the first terminal 3 in a state of being housed in the first housing 5 in the first housing 5 on a free end side.

The contact portion 17 is brought into contact with the outer peripheral surfaces of the two adjacent first terminals 3, 3 by a predetermined urging force of each contact piece 11. As a result, the two adjacent first terminals 3, 3 are electrically connected via the short-circuiting terminal 13.

As described above, by electrically connecting the two first terminals 3, 3 via the short-circuiting terminal 13, it is possible to prevent a potential difference from occurring between the two first terminals 3, 3. Thus, erroneous operation of the airbag can be prevented.

A sliding protrusion 19 is provided on each contact piece 11 provided with the contact portion 17.

The sliding protrusion 19 is provided as a part of the short-circuiting terminal 13 continuing to the contact piece 11. The sliding protrusion 19 protrudes in the width direction which is a direction orthogonal to the fitting direction of the first housing 5 and the second housing 9. The sliding protrusion 19 is provided on the further free end side of the contact portion 17 in the contact piece 11.

When the first housing 5 and the second housing 9 are fit together, the sliding protrusion 19 slides on the sliding slope 21 of the release portion 15 provided on the second housing 9. As a result, the contact piece 11 is displaced, and the contact between the contact portion 17 and the first terminal 3 is released.

The release portion 15 is arranged at the front of the second housing 9 in the direction in which the second housing 9 and the first housing 5 are fit. The release portion 15 includes a sliding slope 21, a support portion 23, a contact housing portion 25, and a displacement portion 29.

The sliding slope 21 is formed of one member which is continuous with the second housing 9 at the end of the second housing 9 on the first housing 5 side. At this time, the sliding slope 21 has an inclined surface inclined upward from the first housing 5 toward the second housing 9.

When the first housing 5 and the second housing 9 are fit together, the sliding slope 21, at its lower end, comes into contact with the sliding protrusion 19 of each contact piece 11 of the short-circuiting terminal 13. When the fitting between the first housing 5 and the second housing 9 progresses, the sliding protrusion 19 of each contact piece 11 slides along the sliding slope 21, and each contact piece 11 is displaced upward.

Due to the displacement of each contact piece 11 by the sliding slope 21, the contact between the contact portion 17 of each contact piece 11 and the first terminal 3 is released, and the electrical connection between the adjacent first terminals 3 and 3 is released.

The support portion 23 is formed of one member continuous with the second housing 9, and has a flat surface extending continuously from the upper end of the sliding slope 21 toward the second housing 9 in the fitting direction.

In a state where the first housing 5 and the second housing 9 are fit to each other, the support portion 23 comes into contact with the sliding protrusion 19 of each contact piece 11 of the short-circuiting terminal 13, thereby holding the state in which each contact piece 11 is displaced upward.

Since the support portion 23 holds the state of displacement of each contact piece 11, each contact piece 11 does not restore downward. Thus, it is possible to hold the contact release state between the contact portion 17 of each contact piece 11 and the first terminal 3.

The contact housing portion 25 is formed of one member continuous with the second housing 9. The contact housing portion 25 is a concave portion arranged in the side opposite to the protruding direction of the sliding protrusion 19, that is an orthogonal direction crossing the fitting direction of the first housing 5 and the second housing 9, with respect to the sliding slope 21 and the support portion 23 in the width direction of the second connector housing 9.

From the start of fitting between the first housing 5 and the second housing 9 to the completion of fitting, the contact housing portion 25 houses the contact portion 17 while its inner wall surface is spaced away so as not to interfere with the contact portion 17 of each contact piece 11 of the short-circuiting terminal 13.

That is, while each contact piece 11 is displaced, the contact portion 17 of each contact piece 11 is housed in the contact housing portion 25, and the contact portion 17 does not interfere with the sliding slope 21, the support portion 23, or the inner wall surface of the contact housing portion 25.

Since the contact housing portion 25 houses the contact portion 17, the contact portion 17 is not involved in the displacement of each contact piece 11. Thus, it is possible to prevent the contact portion 17 from being damaged or deformed. Thereby, the contact portion 17 and the first terminal 3 are appropriately brought into contact with each other, and the connection reliability between the short-circuiting terminal 13 and the first terminal 3 can be secured.

In addition, since there is no opportunity that the contact portion 17 comes into contact with the sliding slope 21 and the support portion 23, even if insulating materials attach to the sliding slope 21 or the support portion 23, they do not attach to the contact portion 17. Therefore, it is possible to prevent the insulating materials from interposing between the contact portion 17 and the first terminal 3, and the connection reliability between the short-circuiting terminal 13 and the first terminal 3 can be secured.

The contact housing portion 25 is provided with an insulating portion 27 which is formed of one member continuous with the second housing 9.

The insulating portion 27 is arranged on the lower end of the sliding slope 21, and in a state where the first housing 5 and the second housing 9 are fit together, the insulating portion 27 is arranged between the contact portion 17 and the first terminal 3.

Since the insulating portion 27 is arranged between the contact portion 17 and the first terminal 3 as described above, the insulating properties between the contact portion 17 and the first terminal 3 is maintained, and it is possible to prevent the short-circuiting terminal 13 and the first terminal 3 from conducting to each other in a state in which the first housing 5 and the second housing 9 are fit together.

The displacement portion 29 is one member continuous with the second housing 9 and is formed in a rib shape such that the tip of the first housing 5 is tapered. The displacement portion 29 is arranged adjacent to the sliding slope 21 in the direction in which the sliding protrusion 19 protrudes.

The displacement portion 29 is arranged so as to be positioned between the two contact pieces 11, 11 of the short-circuiting terminal 13. When the first housing 5 and the second housing 9 are fit together, the displacement portion 29 slides on the sliding protrusion 19 such that each contact piece 11, 11 is displaced in the direction in which each contact piece 11, 11 moves away from the sliding slope 21 in the width direction of each contact piece 11, that is, in the direction of the contact housing portion 25 side.

Due to the displacement of each contact piece 11 by the displacement portion. 29, a restoring force tending to approach the sliding slope 21 acts on each contact piece 11.

The restoring force of each contact piece 11 ensures that the sliding protrusion 19 and the sliding slope 21 can be reliably slid. Thus, it is possible to stabilize the displacement of each contact piece 11 by the slide of the sliding protrusion 19 on the sliding slope 21.

Here, the tapering tip of the displacement portion 29 is arranged forward of the sliding slope 21 in the direction in which the first housing 5 and the second housing 9 are fit.

Therefore, when releasing the fitting between the first housing 5 and the second housing 9, the sliding protrusion 19 of each contact piece 11 finish the slide on the displacement portion 29 after finishing the slide on the sliding slope 21. After each contact piece 11 is restored downward, it is restored in the left-right direction.

Therefore, when the fitting between the first housing 5 and the second housing 9 is released, the contact portion 17 of each contact piece 11 slides on the outer circumferential surface of the first terminal 3 after it finishes contact with the first terminal 3.

Due to the sliding contact of the contact portion 17 with the outer peripheral surface of the first terminal 3, for example, the oxide film formed when tin plating or the like is applied to the contact portion 17 is broken, and the contact portion 17 and the first terminal 3 can be brought into contact with each other on the fresh surface. Thus, the connection reliability between the short-circuiting terminal 13 and the first terminal 3 can be improved.

In this connector 1, when the first housing 5 and the second housing 9 are fit together, the release portion 15 has a sliding slope 21 which slides on the sliding protrusion 19 to displace the contact piece 11. Thus, it is possible to displace the contact piece 11 without sliding the contact portion 17 on the sliding slope 21.

In addition, the release portion 15 includes the support portion 23 which is provided continuously with the sliding slope 21, and which in a state where the first housing 5 and the second housing 9 are fit with each other, comes into contact with the protrusion 19 and holds a state in which and the contact piece 11 is displaced. Thus, it is possible to hold the state in which the contact piece 11 is displaced without bringing the contact portion 17 and the support portion 23 into contact with each other.

Further, the release portion 15 includes a contact housing portion 25 which is arranged in a direction crossing the direction in which the first housing 5 and the second housing 9 are fit together from the sliding slope 21 and the support portion 23, and which houses the contact portion 17 from when fitting of the first housing 5 and the second housing 9 is started until when the fitting is completed. Thus, the contact portion 17 does not interfere with the sliding slope 21 and the support portion 23 of the release portion 15 when the contact piece 11 is displaced. Consequently, the contact portion 17 can be protected.

Since with this connector 1, the contact portion 17 can be protected while the contact piece 11 is displaced, no damage or deformation occurs at the contact portion 17. Thus, the connection reliability between the first terminal 3 and the short-circuiting terminal 13 can be secured.

Since in a state where the first housing 5 and the second housing 9 are fit together, the contact housing portion 25 is provided with an insulating portion 27 arranged between the contact portion 17 and the first terminal 3, insulation between the contact portion 17 and the first terminal 3 can be maintained in a state in which the first housing 5 and the second housing 9 are fit together. Thus, conduction between the short-circuiting terminal 13 and the first terminal 3 can be prevented.

Furthermore, since when the first housing 5 and the second housing 9 are fit together, the release portion 15 has a displacement portion 29 that slides on the sliding protrusion 19 to displace the contact piece 11 in a direction away from the sliding slope 21, the sliding movement between the sliding protrusion 19 and the sliding slope 21 can be maintained by the restoring force of the contact piece 11. Thus, the release portion 15 can stabilize the displacement of the contact piece 11.

In the connector according to the embodiment of the present invention, the displacement portion is positioned between the two contact pieces of the short-circuiting terminal and the two contact pieces are displaced by the one displacement portion, but the present invention is not limited to this. The two displacement portions may be provided for the two contact pieces of the short-circuiting terminal, respectively.

What is claimed is:

1. A connector comprising:

a first housing housing a plurality of first terminals;

a second housing housing a plurality of second terminals connectable to the respective first terminals, the second housing being fittable to the first housing;

a short-circuiting terminal housed in the first housing, the short-circuiting terminal having a contact piece contacting the respective first terminals which are adjacent to each other; and a release portion provided on the second housing, the release portion displacing the contact piece to release contact between the first terminals and the contact pieces, wherein the contact piece comprises:

a contact portion provided so as to be in contact with the first terminal; and a sliding protrusion protruding from the contact portion in a direction intersecting a direction in which the first housing and the second housing are fit together, and wherein the release portion comprises:

a sliding slope sliding on the sliding protrusion to displace the contact piece when the first housing and the second housing are fit together;

a support portion provided to be continuous with the sliding slope, the support portion coming into contact with the sliding protrusion and holding a state in which the contact piece is displaced in a state where the first housing and the second housing are fit together; and a contact housing portion arranged from the sliding slope and the support portion in a direction crossing a direction in which the first housing and the second housing are fit together, the contact housing portion housing the contact portion from when fitting of the first housing and the second housing is started until when the fitting is completed.

2. The connector according to claim 1, wherein the contact housing portion is provided with an insulating portion arranged between the contact portion and the first terminal in a state where the first housing and the second housing are fit together.

3. The connector according to claim 1, wherein the release portion comprises a displacement portion arranged on the protruding direction side of the sliding protrusion with respect to the sliding slope, the displacement portion sliding on the sliding protrusion to displace the contact piece in a direction away from the sliding slope when the first housing and the second housing are fit together.

* * * * *